US007762599B2

(12) United States Patent
Anda

(10) Patent No.: US 7,762,599 B2
(45) Date of Patent: Jul. 27, 2010

(54) LIFTING ANCHOR

(75) Inventor: Roger Anda, Kleppe (NO)

(73) Assignee: Mechanica AS, Stavanger (NO)

( * ) Notice: Subject to any disclaimer, the term of this patent is extended or adjusted under 35 U.S.C. 154(b) by 61 days.

(21) Appl. No.: 11/915,614

(22) PCT Filed: May 19, 2006

(86) PCT No.: PCT/NO2006/000188

§ 371 (c)(1),
(2), (4) Date: Feb. 18, 2008

(87) PCT Pub. No.: WO2006/126888

PCT Pub. Date: Nov. 30, 2006

(65) Prior Publication Data

US 2008/0197646 A1 Aug. 21, 2008

(30) Foreign Application Priority Data

May 27, 2005 (NO) ..... 20052538

(51) Int. Cl.
*B66C 1/54* (2006.01)

(52) U.S. Cl. ..... 294/96

(58) Field of Classification Search ..... 294/94–97, 294/89, 86.24, 86.25
See application file for complete search history.

(56) References Cited

U.S. PATENT DOCUMENTS 1,420,532 A * 6/1922 Edwards ..... 294/86.25
1,619,254 A * 3/1927 Hart ..... 294/86.15
2,594,429 A * 4/1952 Handley ..... 294/96
2,624,610 A * 1/1953 Murphy ..... 294/96
2,687,324 A * 8/1954 Grunsky et al. ..... 294/96
2,719,051 A * 9/1955 Hankins, Jr. ..... 294/86.25
3,265,431 A 8/1966 Burner
3,709,546 A 1/1973 Vaughan
4,948,187 A 8/1990 Blaseck
5,178,429 A 1/1993 Gray et al.

(Continued)

FOREIGN PATENT DOCUMENTS

GB 2337983 12/1999

(Continued)

OTHER PUBLICATIONS

Norwegian Search Report dated Nov. 15, 2007.

*Primary Examiner*—Dean J Kramer
(74) *Attorney, Agent, or Firm*—Patterson & Sheridan, L.L.P.

(57) ABSTRACT

A lifting anchor (1) arranged to be mounted in an opening (33) in a plate wall (31) by use of an installation device, the lifting anchor (1) comprising: a leg (11), one end of the leg (11) being provided with a guide section (13) and the axially opposite end being provided with an attachment section (13') arranged for coupling to a lifting device; and a plurality of dogs (21) encircling a middle section (13") of the leg (11), a first end portion (23) of each dog (21) being provided with an outwardly facing gripping hook (24); and an operational abutment surface (15, 22") between the leg (11) and each dog (21), forming an ramp which is arranged, upon axial movement of the dog (21) along the surface (13") of the leg (11) in the direction of the guide section (13) of the leg (11), to move the gripping hook (24) axially outwards to a gripping position.

10 Claims, 6 Drawing Sheets

U.S. PATENT DOCUMENTS 5,439,235 A * 8/1995 Blackwell ..... 279/2.15
5,597,192 A * 1/1997 Smith ..... 294/96
5,647,627 A * 7/1997 Baessler ..... 294/96
6,010,171 A * 1/2000 Margiottiello ..... 294/94
7,396,060 B2 * 7/2008 Huncovsky ..... 294/96
2002/0096897 A1 * 7/2002 Comardo et al. ..... 294/95

FOREIGN PATENT DOCUMENTS

SE 351742 12/1972

* cited by examiner

LIFTING ANCHOR

The invention regards a lifting anchor for installation by a remote operated device such as an ROV (remotely operated vehicle), more particularly by locking the lifting anchor to a circular opening in a plate wall, e.g. when dismantling subsea installations.

The dismantling of large subsea structures such as whole or parts of steel structures in an offshore oil or gas field will to a large extent involve costly operations where crane barges are used to lift items detached by use of one or more remotely operated vehicles, which vehicles are used in connection with torch-cutting, cutting, sawing etc., and in addition submarine vehicles are used to attach/detach lifting means such as a sling to/from the item to be lifted. To save on the costs associated with the use of this type of equipment a suitable basket is often placed on the seabed, into which dismantled items are placed while waiting for a crane barge to lift the basket to the surface and onto a vessel for further transport. Alternatively, the dismantled items are lifted straight to the surface and brought aboard e.g. a barge.

To minimize the cost of the lifting operations use is often made of a technique where a lifting anchor is positioned and locked into a milled hole, a circular opening, in e.g. a pipe wall, which lifting anchor is arranged to be fastened to a lifting means such as a sling connected to a crane barge. When interconnecting the lifting means and the sling use is often made of shackle that are installed and secured by one or more ROVs. After the item has been placed in the basket the sling is disconnected from the lifting anchor by the ROV, to be ready for a new lifting operation.

The type of lifting anchor used with today's techniques is so expensive to purchase that, if possible, they are used several times in the course of a dismantling operation. Consequently, after a lift has been completed, the lifting anchor must be removed from the item that has been placed in the basket, in order then to be remounted in a new item to be detached from the structure and lifted into the basket. An ROV is used for this purpose. Removing a prior art lifting anchor takes time, and if the item moves as it is placed into the basket it may become difficult or impossible to detach the lifting anchor by using the ROV. This makes the operation both costly and time consuming.

The object of the invention is to remedy or reduce at least one of the drawbacks of prior art.

The object is achieved by the features specified in the description below and in the following claims.

The object of the invention is to provide a lifting anchor with a low purchase cost. This will allow the operator to leave the lifting anchor on the detached item, and so save operational time for the ROV and any other devices.

A further object of the invention is to provide a lifting anchor with a high safety factor through distributing the lifting force transferred from the lifting device via the lifting anchor to the item to be lifted, across a large contact surface between the lifting anchor and the item, also in a situation where the wall surface that provides the contact surface is not flat, e.g. a curved pipe wall surface.

Another object of the invention is to provide a lifting anchor arranged to exhibit the same fastening characteristics vis-à-vis the item to be lifted regardless of the curvature of the wall surface of the item.

Yet another object of the invention is to provide a lifting anchor which is sufficiently compact and light to make it possible to bring a large number of lifting anchors to the work site together with the remote operated device, the lifting anchors being ready for mounting to the items to be lifted.

Thus the invention regards a lifting anchor arranged to be mounted in an opening in the wall surface of a plate structure by use of a remote operated installation device, the lifting anchor comprising:

a leg, one end of the leg being provided with a guide section and the axially opposite end being provided with an attachment section arranged for coupling to a lifting device; and a plurality of dogs encircling a middle section of the leg, the lower part of each dog being provided with an outwardly facing gripping hook; and an operational abutment surface between the leg and each dog, forming a ramp which is arranged, upon axial movement of the dog along the surface of the leg in the direction of the guide section of the leg, to move the gripping hook axially outwards to a gripping position.

Preferably the opening in the plate wall is circular.

Preferably the mounting device is remote-controlled.

Preferably an essentially outwardly directed radial force is applied to the lower portion of each dog by spring loading.

Further preferably an essentially inwardly directed radial force is applied to the upper portion of each dog by spring loading.

Advantageously each dog is kept together with the adjacent dogs by at least one resilient element.

Preferably the resilient element is a flexible annular body.

Preferably the resilient member is a flexible O-ring.

Preferably at least some of the dogs are provided with a friction section that extends substantially in the longitudinal direction of the dog, which friction section is located externally and directly associated with the gripping hook.

Advantageously the friction section comprises a plurality of raised portions that are capable of penetrating the rim of the opening.

Preferably the friction section comprises a plurality of grooves extending essentially transversely of the longitudinal direction of the dog.

The following describes a non-limiting example of a preferred embodiment illustrated in the accompanying drawings, in which.

Figure 1:
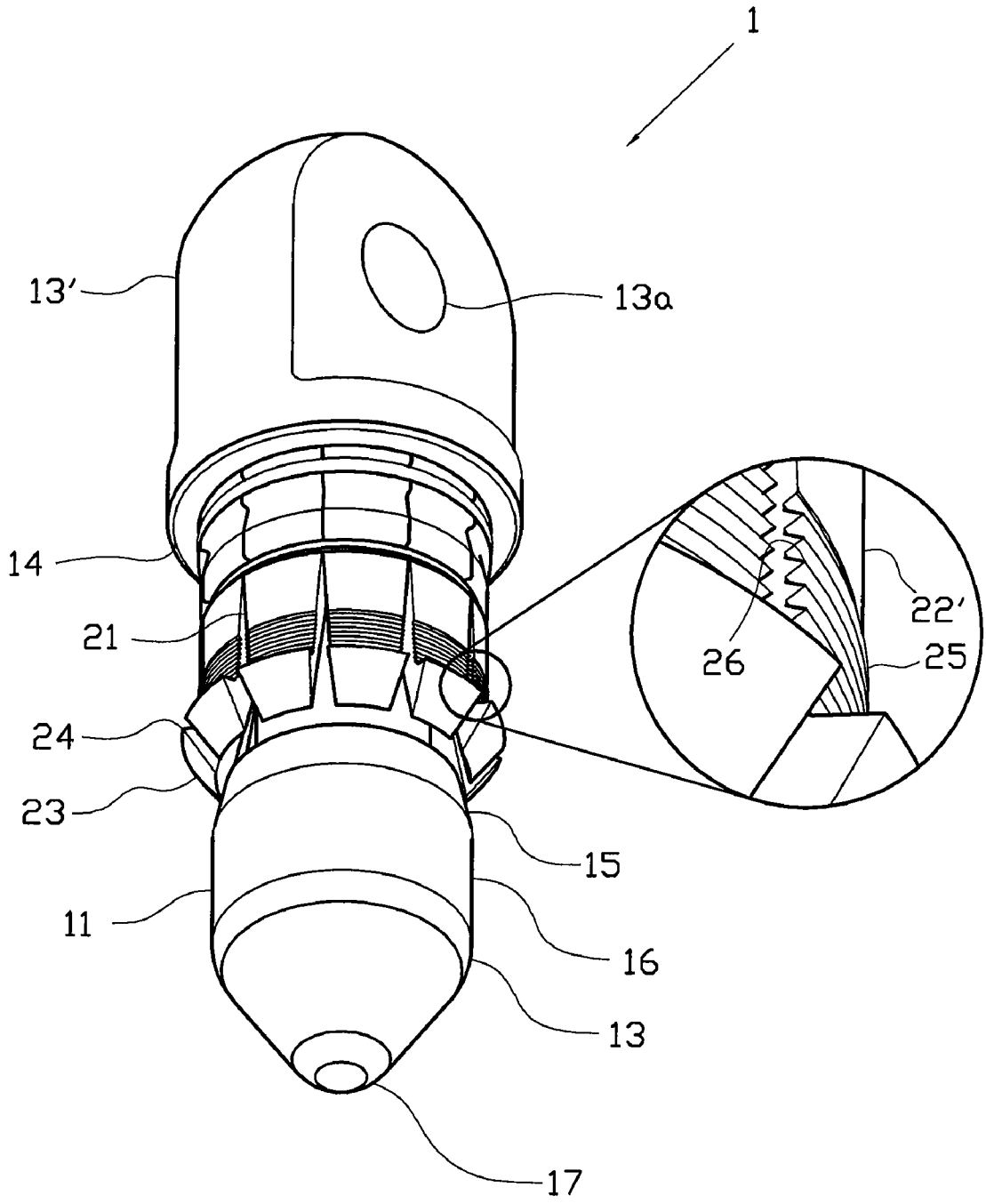
FIG. 1 is a perspective view of a lifting anchor according to the invention, seen at an angle in towards the guide section of the lifting anchor, with part of it being shown in a larger cut-out.
Figure 2:
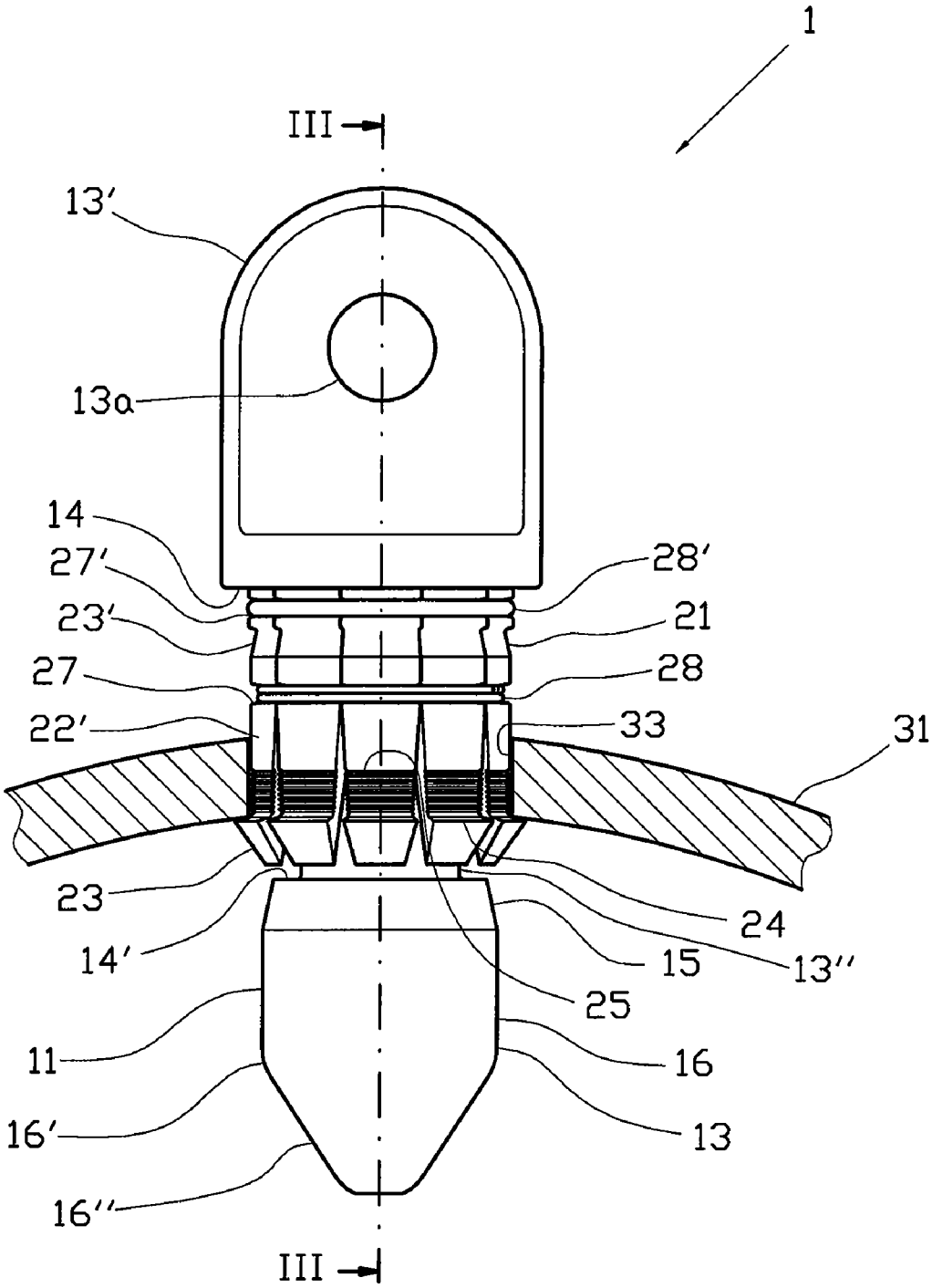
FIG. 2 is a side view of a lifting anchor according to the invention inserted through an opening in a pipe wall.
Figure 3:
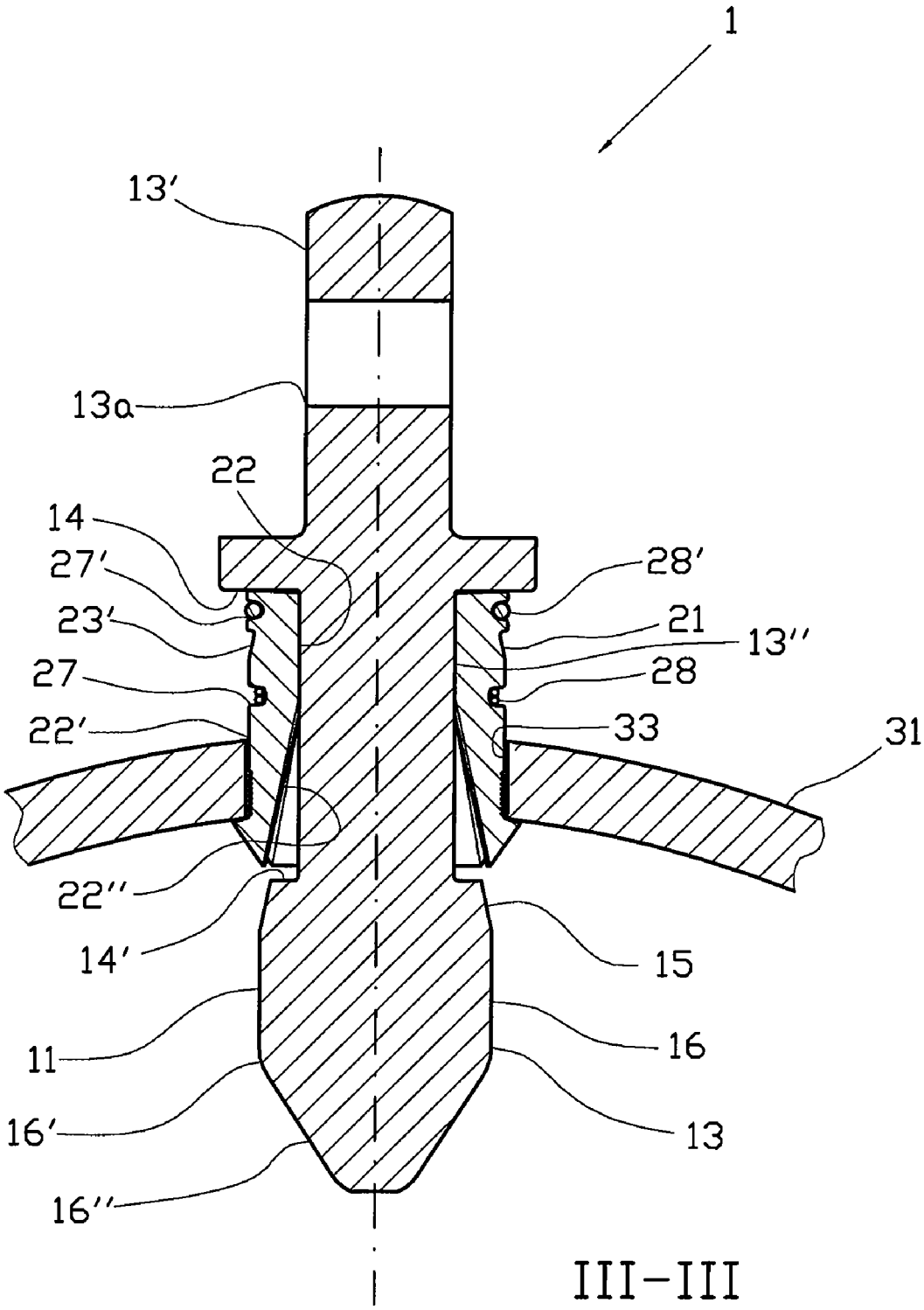
FIG. 3 shows a longitudinal section III-III through the lifting anchor as shown in FIG. 2.
Figure 4:
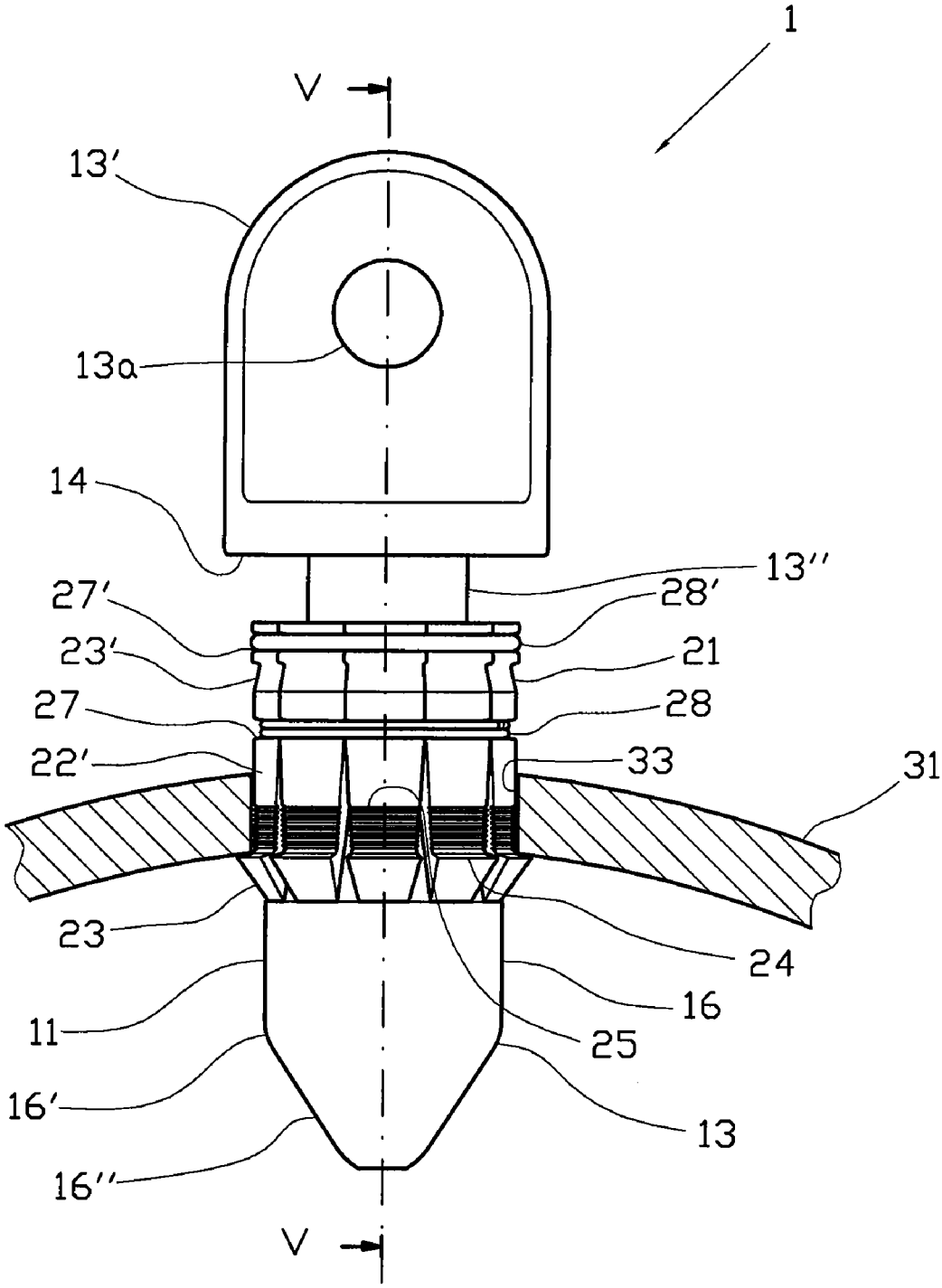
FIG. 4 is a side view of the lifting anchor according to the invention, where the leg of the lifting anchor has been pulled up and the dogs are tensioned against the periphery of the opening.
Figure 5:
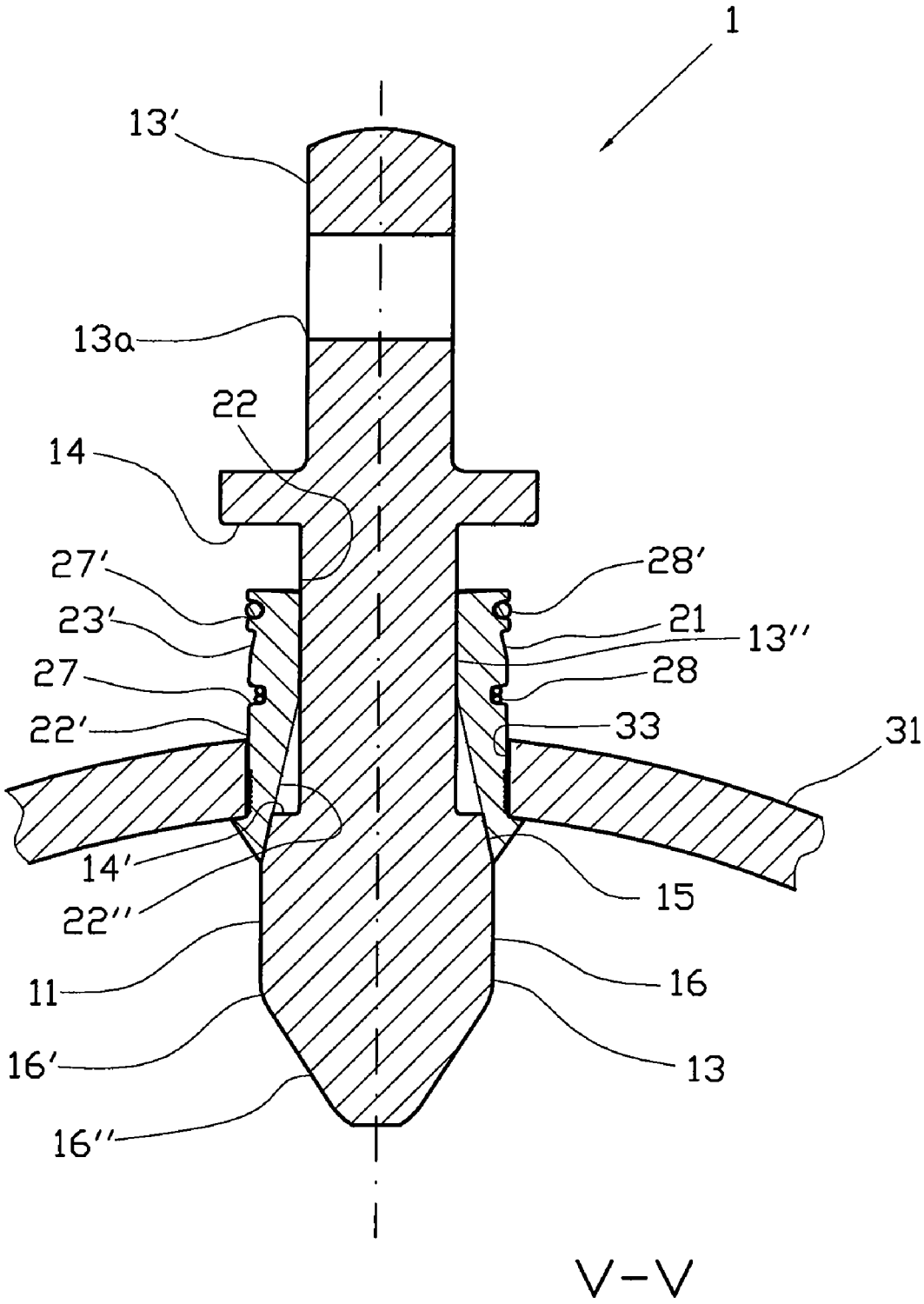
FIG. 5 shows a longitudinal section V-V through the lifting anchor as shown in FIG. 4.
Figure 6:
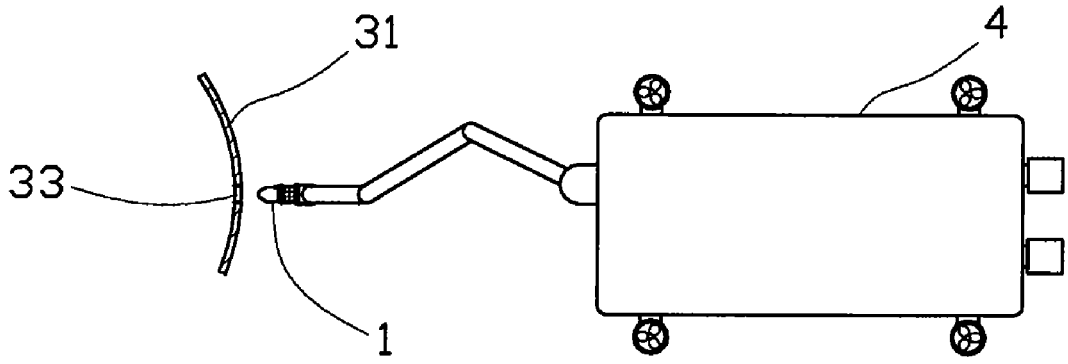
FIG. 6 is view of a Remotely Operated Vehicle with the lifting anchor.

In the figures, reference number 1 denotes a lifting anchor comprising a leg 11 and several dogs 21, in this embodiment a total of ten dogs 21, encircling a portion of the leg 11.

A tubular item 31 has a circular opening 33.

One end of the leg 11 is provided with a guide section 13 and the axially opposite end is provided with an attachment section 13'. The attachment section 13, is provided with a hole 13*a* arranged to receive a fastener for a lifting device, e.g. a shackle (not shown). A middle section 13" is cylindrical. The transition between the attachment section 13' and the middle section 13" forms a shoulder 14 having an annular surface which is perpendicular to the central axis of the leg 11 and faces the middle section 13" of the leg 11. The transition between the middle section 13" and the guide section 13 forms a shoulder 14' having an annular surface which is perpendicular to the central axis of the leg 11 and faces the middle section 13" of the leg 11. A transition region 15 adjacent to the shoulder 14' is conical, its diameter increasing in the direction of the guide section 13. The guide section 13 is provided with a cylindrical section 16 that turns into a conical end section 16" via a rounded transition region 16', the end section 16" tapering towards the end 17 of the leg 11.

The general shape of each dog 21 is part cylindrical, as the inner first face 22 of each finger 21 matches the central cylindrical section 13" of the leg 11 and an outer face 22' is concentric to the inner first face 22. An inner second face 22", also partly cylindrical in shape, slants outwards in the longitudinal direction of the dog 21, away from the inner first face 22, the inner second face 22" and a gripping hook 24 projecting up from the outer face 22' of the dog 21 together forming a wedge shaped first end portion 23. The inner second face 22" is complementary to the transition region 15 of the leg 11, and together they form an operational ramp at the movement of the dogs 21 in the axial direction of the leg 11. The outer face 22' is provided with a friction section 25 formed by several parallel elongated raised portions 26 that extend transversely of the longitudinal direction of the dog 21 and are provided with a sharp edge. In the outer face 22', opposite the boundary line between the two inner faces 22, 22", there is formed a recessed groove 27 arranged to receive a string-like annular body 28 which surrounds the leg 11 and the dog 21 when these encircle the leg 11. At the other end portion 23' of the dog 21 there is formed a recessed groove 27' arranged to receive a flexible O-ring 28'.

The resulting maximum diameter of the lifting anchor 1 at the gripping hooks 24, with no loading on the dogs 21, is smaller that the outer diameter of the shoulder 14.

When the lifting anchor 1 is ready, the dogs 21 enclose the middle section 13" of the leg 11, the string-like annular body 28 keeping the dogs 21 together. The flexible O-ring 28' resiliently urges the second end portion 23' of the dogs 21 in the radial direction towards the leg 11, making the inner first face 22 bear against the cylindrical middle section 13" of the leg 11. The dogs 21 are arranged so as to be able to slide together along the middle section 13", in the axial direction. Each dog 21 is arranged so as tilt about the boundary line between the inner faces 22, 22" upon application of compressive force against the first end portion 23, to allow the first end portion 23 to move inwards in the radial direction, to abut the leg 11.

Before the lifting anchor 1 is attached to the tubular item 31 to be lifted, a circular opening 33 is created in a suitable location in the wall of the item, in a manner that is known per se. The diameter of the opening must be smaller than the outer diameter of the shoulder 14 but larger than the resulting maximum diameter of the lifting anchor 1 across the outer face 21' of the dogs 21 when there is no loading on the dogs 21.

The lifting anchor 1 is placed in the opening 33, the wedge shaped end portions of the dogs 21 being urged inwards in the radial direction until the gripping hooks 24 have passed through the opening. The flexible O-ring 28' will then force the dogs 21 back to their initial position. As the lifting device is connected to the attachment section 13' and an axial pulling force is applied in the leg 11, away from the item 31, the leg 11 is displaced in the axial direction relative to the dogs 21. The conical transition region 15 slips under the dogs 21 and along the inner second faces 22" of the dogs 21. The greater the pulling force being applied to the lifting anchor, the greater the force of pressure being applied to the dogs.

When fastening the lifting anchor 1 in the tubular item 31 having a curved surface in the form of a pipe wall, only those dogs 21 that are positioned in a transverse plane to the axial direction of the curvature will grab hold using their gripping hooks 24, provided there is no deformation of the wall surface of the tubular item 31 or the dogs 21. The remaining dogs 21 will grip the opening 33 by using their friction sections 25. A ROV 4 may be used to place the lifting anchor 1 in the opening 33 of the tubular item 31.

Advantageously the leg 11 and the dogs 21 of the lifting anchor 1 are made from steel, preferably cast.

The invention claimed is:

1. A lifting anchor arranged for non-releasable fastening in an opening in a plate wall by means of an installation device, the lifting anchor comprising:

a leg at one end provided with an attachment section arranged to be connected to a lifting device, and at an axially opposite end provided with a guide section; and a plurality of individual dogs encircling a middle section of the leg, a first end portion of each dog being provided with an outwardly facing gripping hook, and an operational abutment surface between the leg and each gripping hook forming a ramp arranged, upon axial movement of the dog along the surface of the leg in the direction of the guide section, to move the gripping hook axially outwards to a gripping position, wherein each dog is kept together with the adjacent dogs by at least one resilient element arranged to apply an essentially radially directed outward force to the first end section of each dog and an essentially radially directed inward force is applied to a second end portion of each dog through spring loading applied by the at least one resilient element.

2. The lifting anchor in accordance with claim 1, wherein the opening in the plate wall is circular.

3. The lifting anchor in accordance with claim 1, wherein the installation device tool is remote-controlled.

4. The lifting anchor in accordance with claim 1, wherein the resilient element is a flexible annular body.

5. The lifting anchor in accordance with claim 1, wherein the resilient element is a flexible O-ring.

6. The lifting anchor in accordance with claim 1, wherein an outer surface of at least some of the dogs is provided with a friction section directly associated with the gripping hook, which friction section extends essentially in the longitudinal direction of the dog.

7. The lifting anchor in accordance with claim 6, wherein the friction section comprising a plurality of raised portions that are capable of penetrating the rim of the opening.

8. The lifting anchor in accordance with claim 6, wherein the friction section comprises a plurality of grooves extending essentially transversely of the longitudinal direction of the dog.

9. The lifting anchor in accordance with claim 1, wherein an outer face of at least some of the dogs includes a recessed groove arranged to receive an annular body.

10. The lifting anchor in accordance with claim 9, wherein the annular body is configured to keep the dogs together.

* * * * *

UNITED STATES PATENT AND TRADEMARK OFFICE

CERTIFICATE OF CORRECTION

PATENT NO. : 7,762,599 B2
APPLICATION NO. : 11/915614
DATED : July 27, 2010
INVENTOR(S) : Anda It is certified that error appears in the above-identified patent and that said Letters Patent is hereby corrected as shown below:

Column 4, Claim 3, Line 42, please delete "tool".

Signed and Sealed this

Sixteenth Day of November, 2010

David J. Kappos

David J. Kappos
*Director of the United States Patent and Trademark Office*